US006520159B2

(12) United States Patent
White et al.

(10) Patent No.: US 6,520,159 B2
(45) Date of Patent: Feb. 18, 2003

(54) ENGINE CONVERTER MISFIRE PROTECTION METHOD AND APPARATUS

(75) Inventors: Vincent A. White, Northville, MI (US); Randal L. DuFresne, Orchard Lake, MI (US)

(73) Assignee: General Motors Corporation, Detroit, MI (US)

( * ) Notice: Subject to any disclaimer, the term of this patent is extended or adjusted under 35 U.S.C. 154(b) by 128 days.

(21) Appl. No.: 09/817,689

(22) Filed: Mar. 26, 2001

(65) Prior Publication Data

US 2002/0134357 A1 Sep. 26, 2002

(51) Int. Cl.[7] ..... F02D 7/00
(52) U.S. Cl. ..... 123/481; 123/198 DB
(58) Field of Search ..... 123/481, 198 DB

(56) References Cited

U.S. PATENT DOCUMENTS 4,445,326 A 5/1984 Lyon
5,431,044 A 7/1995 Kiess et al.
5,437,154 A 8/1995 Sato et al.
5,700,954 A 12/1997 Sinha et al.
5,735,246 A 4/1998 Vincent et al.
5,822,710 A 10/1998 Mezger et al.
5,826,563 A * 10/1998 Patel et al. ..... 123/198 F
6,092,015 A * 7/2000 Takahashi et al. ..... 123/406.34
6,269,632 B1 * 8/2001 Schmitz ..... 123/479
6,360,724 B1 * 3/2002 Suhre et al. ..... 123/198 F
6,405,705 B1 * 6/2002 Dunsworth et al. ..... 123/305

* cited by examiner

*Primary Examiner*—John Kwon
(74) *Attorney, Agent, or Firm*—Anthony Luke Simon

(57) ABSTRACT

An engine catalytic converter misfire protection method and apparatus which controls engine parameters in response to the detection of potentially damaging cylinder misfire. A misfire counter responsive to engine cylinder misfires, counts misfires over a predetermined time period, with the positive changes in the counter output integrated and then compared with a threshold count to determine if the count corresponds to a damaging misfire condition. The apparatus and method simultaneously samples a short term fuel correction signal and compares the short term fuel correction signal with a second threshold. When both thresholds are exceeded substantially at the same time, the apparatus and method shut off fuel to the misfiring cylinder and shuts off the short and long term fuel control. Verification that the proper cylinder has the fuel shut off is made by repeating the control sequence to determine if the fuel has been shut off to the same cylinders.

7 Claims, 3 Drawing Sheets

ENGINE CONVERTER MISFIRE PROTECTION METHOD AND APPARATUS

BACKGROUND OF THE INVENTION

The present invention relates, in general, to apparatus and methods for protecting a catalytic converter from engine misfires in a multi-cylinder internal combustion engine.

Modem spark ignition engines utilize an engine control computer or ECC. Outputs to the engine from the ECC include signals that control the electric spark to each individual cylinder. Individual signals are also provided to control the opening and closing of the individual cylinder fuel injectors.

The ECC receives information from various engine sensors. Typically, the sensors provide information on inlet mass air flow, throttle position, intake manifold pressure, crankshaft position, engine coolant temperature and exhaust oxygen content. A typical crankshaft position sensor might include a sensing device, either magnetic, optical, Hall effect, etc., which detects the presence of a series of teeth or marks on the engine crankshaft. A tooth in this configuration may be uniquely designed to provide a reference point such that the identification of a particular cylinder is indexed to the reference point.

A large number of engines are also equipped with an exhaust oxygen sensor. The sensor is necessary for the precise control of the air to fuel ratio (A/F) of the engine. Typically, the exhaust oxygen sensor outputs a high signal when the exhaust A/F ratio is rich of a stoichiometric value. When the exhaust A/F is lean of stoichiometry, the sensor output is low. The oxygen sensor is typically used in a closed loop fuel control arrangement which has both short term and long term learn corrections. This precisely regulates the engine A/F ratio to a stoichiometric value. An engine exhaust catalytic converter, which is used to promote full oxidation of hydrocarbons, carbon monoxide, and reduction of nitrogen oxides present in the engine exhaust gases, operates very efficiently at a stoichiometric exhaust A/F ratio.

It has been previously found that a catalytic converter may be damaged if engine cylinder misfire occurs. The source of such misfires could be a disconnected or broken spark plug wire or a wire to a fuel injector. Other engine problems can result in the lack of or incomplete combustion of a particular cylinder which is also referred to as a misfire.

Typically, when cylinder misfire occurs, the unburned fuel that is discharged into the exhaust passage from the misfiring cylinder greatly increases the reaction temperature of the converter to an extent that may lead to overheating of the converter.

The vehicle manufacturers provide alarms, such as a flashing light, to alert the vehicle driver when damaging engine misfire occurs above a threshold level. Information from the crankshaft position sensor is commonly used to detect engine misfire. The speed variation of the crankshaft is measured about the combustion event of each cylinder. Speed variations are compared to known operating characteristics to deduce when a misfire occurs. An abnormal crankshaft speed variation at the expected power stroke may be counted as a misfire for a specific cylinder. A number of misfires may be counted for a certain amount of time, i.e., five seconds, which defines a known as "cylinder misfire counter". this type of misfire detector can experience certain difficulties accurately detecting engine cylinder misfire. Frequency related torsional resonance of the crankshaft may give a false signal at certain operating RPMs. Driveline induced speed fluctuations to the crankshaft may also occur when the vehicle is operated on a rough road surface.

It would also be desirable to provide a method and apparatus which is capable of taking corrective action to protect the engine catalytic converter in the event of an engine cylinder misfire. It would also be desirable to provide a method and apparatus which is capable of preventing the removal of engine power when no engine misfire exists.

SUMMARY OF THE INVENTION

The present invention is a method and apparatus for protecting an engine converter during misfire in at least one cylinder of a multi-cylinder internal combustion engine.

The method controls engine parameters during an engine cylinder misfire in at least one cylinder of a multi-cylinder internal combustion engine. The method comprises the steps of:

detecting a cylinder misfire in at least one cylinder of a multi-cylinder engine;

counting the number of misfires in each cylinder on a cylinder by cylinder basis;

integrating the misfire count for each positive change of the misfire count for each cylinder over time;

establishing a first threshold based on the integrated misfire count;

establishing a second threshold for a short term fuel control signal adjusting the flow of fuel to each cylinder of the engine;

comparing the integrated misfire count and the short term control signal with the first and second thresholds; and if the first and second thresholds are exceeded at substantially the same time, shutting off fuel to at least one cylinder of the engine in which the misfire is occurring and shutting off the short and long term fuel control.

The method of the present invention optionally includes a verification sequence including the steps of:

upon the occurrence of a detected misfire, determining in a first determination the engine cylinder numbers in which the fuel is shutoff;

in a second determination repeating all of the method to determine the cylinder number of cylinders in which fuel is shut off;

comparing the cylinder numbers from the first determination with the cylinder numbers from the second determination to determine a match;

if the cylinder numbers in the first and second determinations match, ending misfire detection control; and if the cylinder numbers in the first and second determinations do not match, turning on fuel to all of the cylinders and resetting the misfire counter to a reset value.

The apparatus of the present invention includes means for receiving an output signal indicative of the occurrence of a misfire in at least one cylinder of a multi-cylinder internal combustion engine. A counter counts the number of misfires in each cylinder of the engine on a cylinder by cylinder basis. Means are provided for integrating the misfire counter positive changes over time. Means are also provided for comparing the integrated misfire counter output with a first threshold. Means are provided for comparing a fuel short term correction signal with a second threshold. Means are provided for determining when the integrated misfire counter output exceeds the first threshold at substantially the same time that the fuel short term correction signal exceeds the second threshold. The determining means provides an output signal for corrective engine control which is used by an engine controller to shut off the fuel to the engine cylinders in which misfire is occurring, and shut off the short and long term fuel correction.

Means are optionally provided for verifying that the fuel has been shut off to the proper cylinders in which misfire was occurring. The verification means or sequence includes means for redetermining the number of cylinders in which fuel is to be shut off due to the occurrence of misfire and in comparing the number of cylinders in which fuel has been shut off by a first execution of the control method with the number of cylinders in which fuel is to be shut off from a second execution or determination by the control method.

If the cylinder numbers match in the two determinations, engine misfire control is terminated. However, if the engine cylinder numbers do not match, fuel is turned on to all of the engine cylinders and the various perimeters in the control method and apparatus of the present invention are reset to nominal values for the restart of the sequence of the present invention.

The engine converter misfire protection method and apparatus of the present invention uniquely determines when damaging cylinder misfire is occurring, which cylinder of the engine in which the misfire is occurring and takes corrective action by shutting off the flow of fuel to the misfiring cylinder and shutting off the short and long term fuel correction. This prevents the output of the engine oxygen sensor from switching to a state which previously resulted in the application of additional fuel to the engine cylinders. The present control method and apparatus protects the converter and maintains the temperatures within the various portions of the converter at essentially nominal operating temperatures despite the occurrence of cylinder misfires.

BRIEF DESCRIPTION OF THE DRAWINGS

The various features, advantages and other uses of the present invention will become more apparent by referring to the following detailed description and drawings in which.

DETAILED DESCRIPTION OF THE PREFERRED EMBODIMENTS

Figure 1:
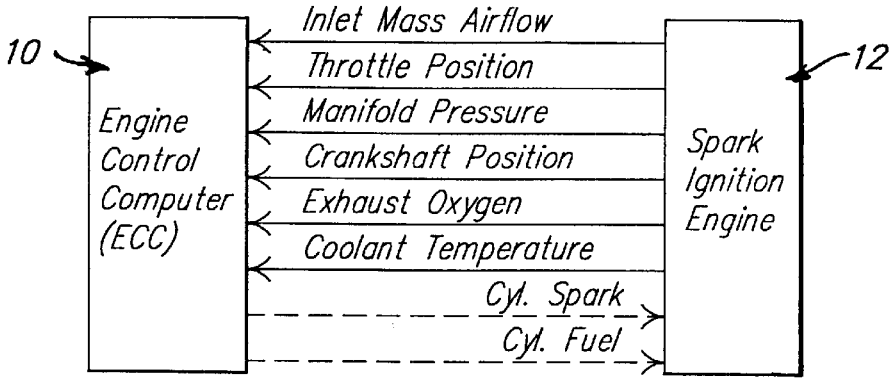
FIG. 1 is a block diagram depicting conventional signals from a spark ignition engine to an engine control computer which are used in the present method and apparatus.

Referring now to FIGS. 1–4B of the drawing, there is depicted an engine converter misfire protection method and apparatus which, in the event of an engine misfire, and, based on comparison with predetermined threshold values, controls the shutoff of fuel to the misfiring cylinder(s) and shuts off the short and long term fuel control to prevent a temperature rise in the engine catalytic converter which could damage the converter.

It will be understood that although the following description of the detection of a misfire in one particular cylinder of an internal combustion, spark ignition engine, the present method and apparatus contemplates utilizing the same control for all of the cylinders of the engine. Thus, all engine cylinders are monitored for cylinder misfire and compared with appropriate thresholds for taking corrective action, when necessary, to protect the converter.

Refer now to FIG. 1, there is depicted a pictorial representation of a portion of the signal flow between an engine control computer (ECC) 10 and each cylinder of a spark ignition, internal combustion engine 12. Output signals from the engine 12 to the ECC 10 include signals which are used by the ECC 10 to control the electrical spark to each individual cylinder in the engine 12. Individual signals that are used by the ECC 10 to control the opening and closing of the individual cylinder fuel injector are also shown in FIG. 1.

The crankshaft position signal is particularly useful in implementing the converter misfire protection method and apparatus. As is typical, a crankshaft position sensor might include a sensing device, such as a magnetic, optical, Hall effect, or other, etc., not shown, mounted on the engine 12 which detects the presence of a series of teeth or marks located on the engine crankshaft during rotation of the crankshaft. One tooth on the crankshaft may be uniquely designed to provide a reference point such that the identification of a particular cylinder is provided as an index. As the crankshaft rotates, crankshaft position information is sent from the crankshaft position sensor on the engine 12 to the ECC 10.

As is further conventional, an engine exhaust oxygen sensor, also not shown, is mounted on the engine 12 and provides a measure of exhaust oxygen content. This is used by the ECC 10 to control the air/fuel (A/F) ratio. Typically, when the A/F ratio is rich of a stoichiometric value, the output of the engine exhaust sensor is a logic "high" signal. When the exhaust A/F ratio is lean of stoichiometry, the output of the engine exhaust sensor is a logic "low" signal. The engine exhaust sensor output is typically used in a closed loop fuel control arrangement which has both a short term and long term learn correction factors. These factors are used by the ECC 10 to regulate the engine A/F ratio to a stoichiometric value.

Figure 2:
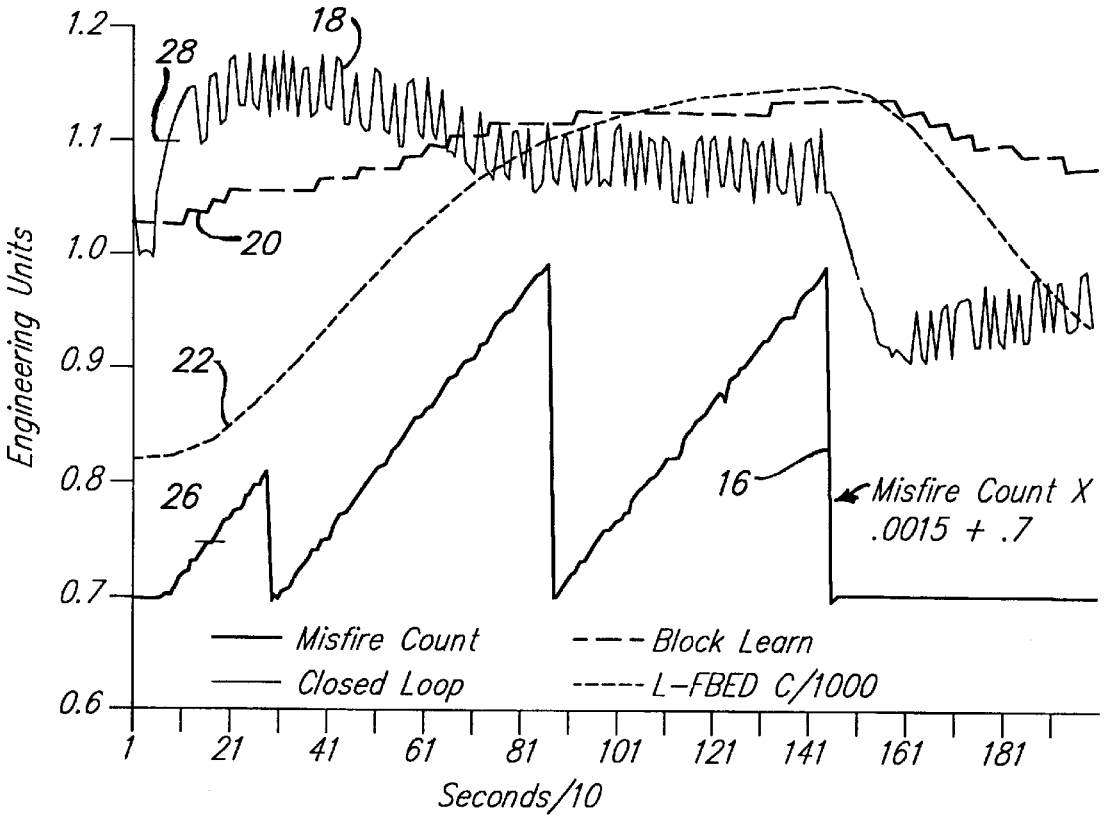
Prior Art FIG. 2.
FIG. 2 is a graph depicting various engine parameters during cylinder misfiring using a prior art misfire detector, the conditions are cylinder #1 spark misfire, 2200 RPM, 75 gram/sec.

To better understand the features and advantages of the present engine converter protection method and apparatus, reference can be had to FIG. 2 which is a graph depicting the short term and the long term A/F correction factors as well as the temperature in degrees Celsius of the front bed region of an engine catalytic converter. In FIG. 2, the incremental value of the output 16 of one misfire counter is depicted. The misfire counter is part of a conventional misfire detector which is based on crankshaft speed fluctuations as measured by crankshaft position sensors described above. Unique changes in rotational speed of the crankshaft typically results from a misfire condition in one of the engine cylinders.

In the present implementation, the misfire counter counts to a predetermined value as shown in FIG. 2 and then resets to a reset or start value. Alternately, a misfire counter could be employed which continually increases in misfire counts throughout the entire misfire cycle.

Waveform 18 represents the closed loop or short term A/F fuel ratio correction value. Waveform 20, labeled "Block Learn" represents the long term learned close loop A/F fuel ratio correction value. Waveform 22 depicts the temperature in degrees Celsius of the front bed region of the engine catalytic converter.

During misfire, such as a misfire in the first cylinder of the engine 12, the lack of spark signal to the first cylinder causes non-combusted air and fuel to be exhausted from the engine to the oxygen sensor which is typically located between the engine exhaust manifold outlet and the catalytic converter. The oxygen sensor misinterprets the high air value as lean of stoichiometric operating condition. As a result, both the short term or closed loop control signal 18 and the long term or "Block Learn" control loop signal 20 respond by adding fuel to the air/fuel mixture in all cylinders of the engine. This increased fuel flow to all cylinders plus ignition of the noncombusted air and fuel from the misfiring cylinder increases the temperature in the front bed region of the catalytic converter as shown by the waveform 22. Burning of the additional fuel and air on the surface of the substrate of the catalytic converter causes the temperature to eventually rise above the melting point of the precious metal typically coated on the catalytic substrate thereby degrading operation of the catalytic converter. It should be noted in FIG. 2 that at time=14.5 seconds (145) the first cylinder misfire terminates. The resulting "Closed Loop" and "Block Learn" values gradually decrease along with a decrease in the temperature of the front bed region of the catalytic converter generally toward normal values.

The present invention makes use of the oxygen exhaust sensor output and the integrated misfire count output over time to control the supply of fuel to the cylinders. Referring now to FIG. 2, the output 16 of the misfire counter linearity increases in the number of misfire counts from a nominal or reset value to a maximum and then resets back to the reset value resulting in the generally sawtooth waveform shown in FIG. 2. The misfire counter output 16 is sampled a predetermined number of times. At the same time that the misfire counter output 16 is sampled to obtain an output magnitude value, the short term or "closed loop" fuel control learn signal 18 is sampled. The misfire counter output signal 16 is compared with a noise threshold 26 by example only in FIG. 2 to determine an enable condition The integrated misfire count is compared with a first threshold which is set high enough to establish with a high degree of confidence that the catalytic converter will be damaged. Similarly, the closed loop or short term fuel learn signal is compared with a second threshold 28 shown in FIG. 2. If both the first and second thresholds 28 are respectively exceeded at the same time by the integrated misfire count output and the short term or closed loop signal 18, a damaging misfire is determined to be occurring. Generally, this comparison will detect a large spike or big increase in the magnitude of the short term or closed loop signal 28 when a misfire is occurring.

The misfire counter signal 16 is integrated over time by summing the previous value of the misfire counter with the positive change in the current value of the misfire counter to improve signal integrity.

As the signals shown in FIG. 2 are particular to each cylinder of the engine and monitored by the ECC 10, the ECC 10 immediately knows in which cylinder a misfire is occurring. The ECC 10 is then capable of turning off the supply of fuel to the misfiring cylinder and shutting off the short and long term fuel control. The output are reset to nominal values. This prevents an increase in fuel in the exhaust stream supplied to the catalytic converter and thereby prevents burning of such fuel in the converter which has previously led to an undesirable temperature rise in the catalytic converter. This sequence is depicted more clearly in FIGS. 4A and 4B which show a control sequence according to the present method.

The control process starts at the "Begin" step 40 wherein all monitored values are reset to zero or a nominal start value. A determination can be immediately made in step 42 if the misfire counter output signal 16 exceeds a predetermined noise threshold 26. If the answer is no, control returns to the "Begin" step 40. However, if the misfire counter output 16 exceeds the calibrated noise threshold 26, the ECC 10 disables the closed loop long term or "Block Learn" signal for a calibrated time in step 44.

Next, the misfire counter positive change output 16 is integrated by first determining in step 46 if the misfire counter output 16 is greater than the previous value of the misfire counter output 16. If yes, the integrated misfire counter 48 is set equal to the previous value plus the current misfire counter 16 to provide an integration of the positive changing misfire counter output signal over time for increased signal integrity.

At the same time the misfire counter output 16 is sampled, the short term or "Closed Loop" signal is compared to threshold 28 in step 50. If the short term or "Closed Loop" fuel control correction value is greater than the threshold 28, a determination is then made by the ECC 10 in step 52 to determine if the engine is in a valid operating region for misfire protection. This is generally a function of the engine cylinder RPM and manifold pressure as it may not be desirable to shut off the fuel to a misfiring engine under certain engine operating conditions, such as during rapid acceleration or a downhill descent, etc.

Figure 4A:
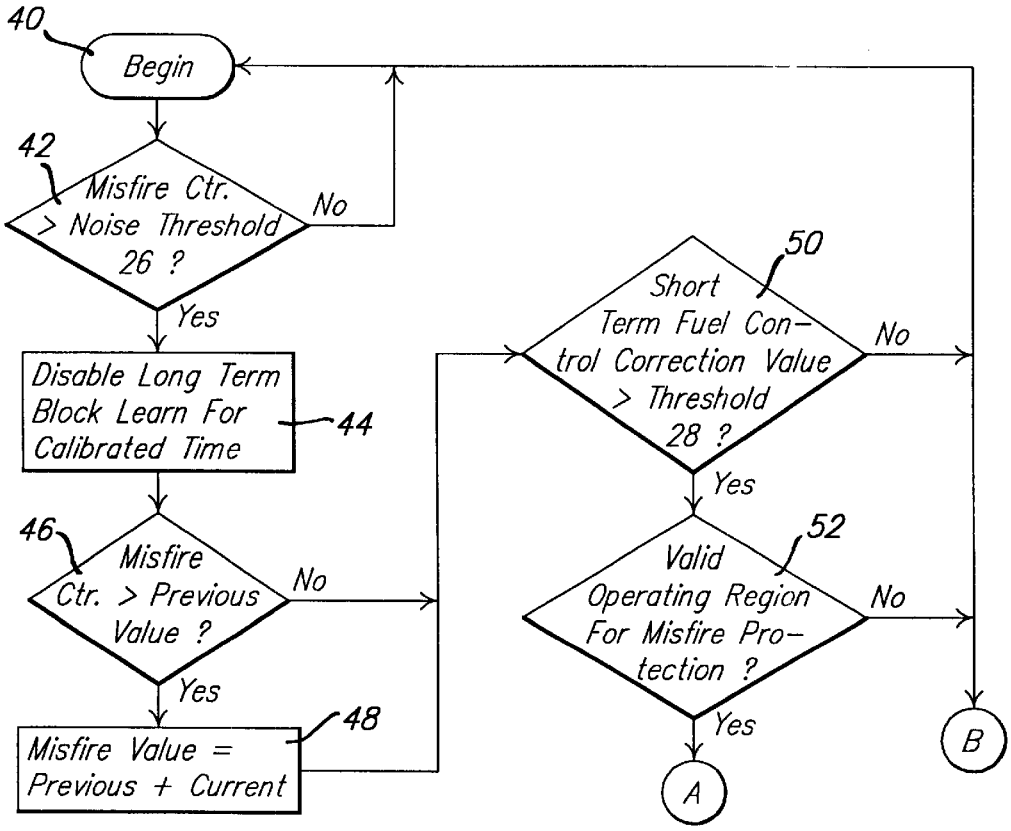
FIGS. 4A and 4B are flow diagrams depicting the sequence of operation of the method and apparatus according to the present invention.
Figure 4B:
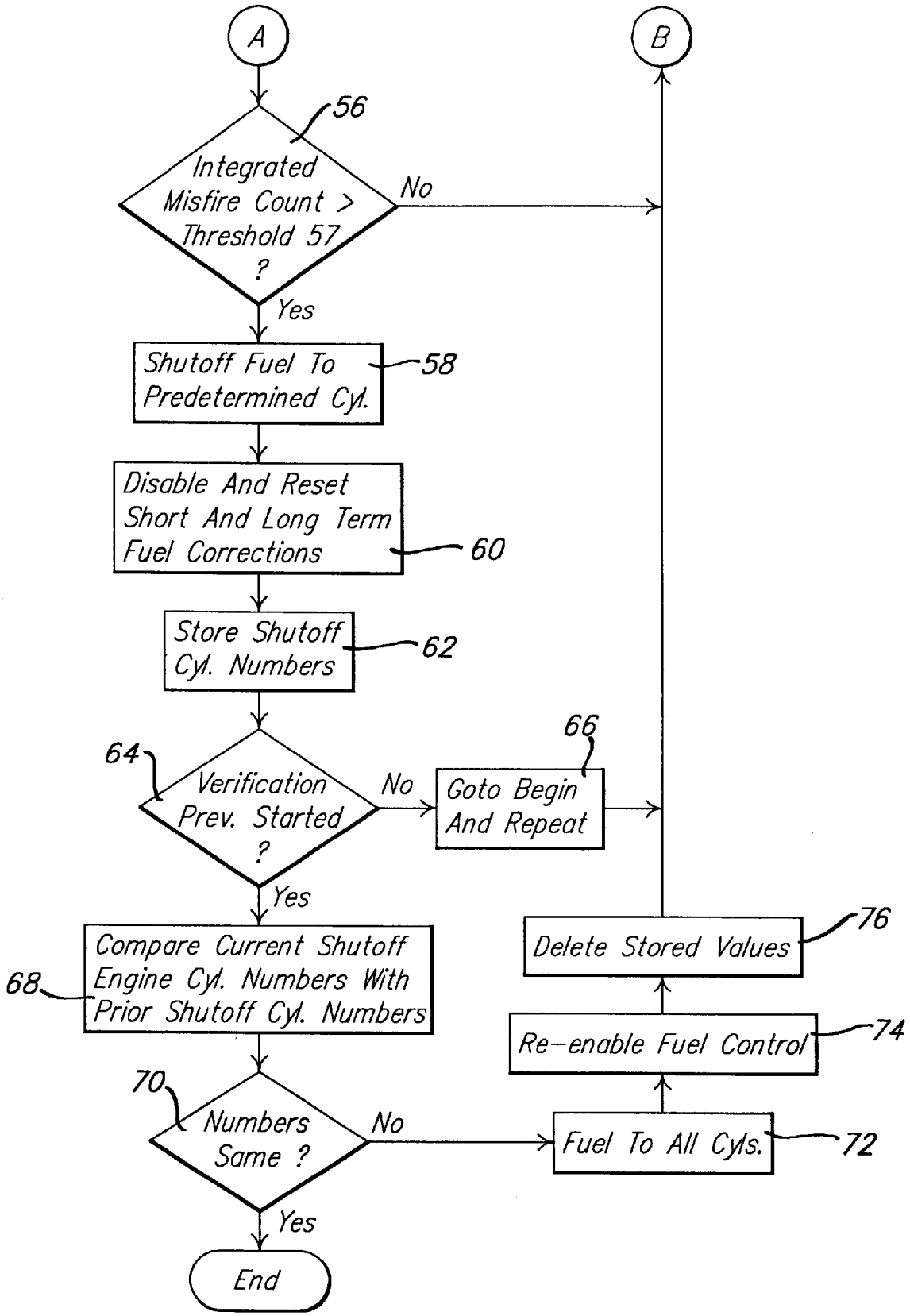

Next, the ECC 10 in step 56 shown in FIG. 4B samples the integrated 30 misfire counter output from step 48 and compares it to the threshold 57 to determine if the integrated misfire counter is greater than the threshold 57. If the answer is yes, since both the short term fuel correction control value and the integrated misfire counter output from step 48 are greater than the thresholds 28 and 57, respectively, the ECC 10 determines that a significant misfire is occurring and then, in step 58, shuts off fuel to the specific cylinder in the engine 12 in which the misfire is occurring. The ECC 10 in step 60 then disables and resets the short term and long term fuel correction signals to nominal values, and then stores the cylinder number(s) which has been shut off from fuel flow in step 62.

This will complete the normal sequence of the present method and apparatus. However, an optional verification sequence is provided starting at step 64. In step 64, a determination is made after the completion of step 62 if the verification process has been previously started. If not, the ECC 10 returns to the "Begin" step 40 and repeats the previously described steps, omitting steps 44, 50, 60, to come up with the cylinder or number of the cylinders in which a misfire is occurring when the appropriate thresholds 26 and 57 have been exceeded by the misfire counter 16 and the integrated misfire counter 48, respectively. In step 68, the current engine cylinder numbers which are shut off to fuel flow are compared with the prior shut off engine cylinder numbers from step 62. If the cylinder numbers match as determined in step 70, control ends until the next start of the misfire control which can occur on a timed basis.

If the cylinder numbers are not the same as determined in step 70, fuel is re-supplied to all of the cylinders in step 72 and the short term and the long term fuel control are enabled in step 74. The stored misfire integrated values are deleted in step 76 and the ECC 10 returns to the "Begin" step 40 on the next activation of the misfire control sequence.

Figure 3:
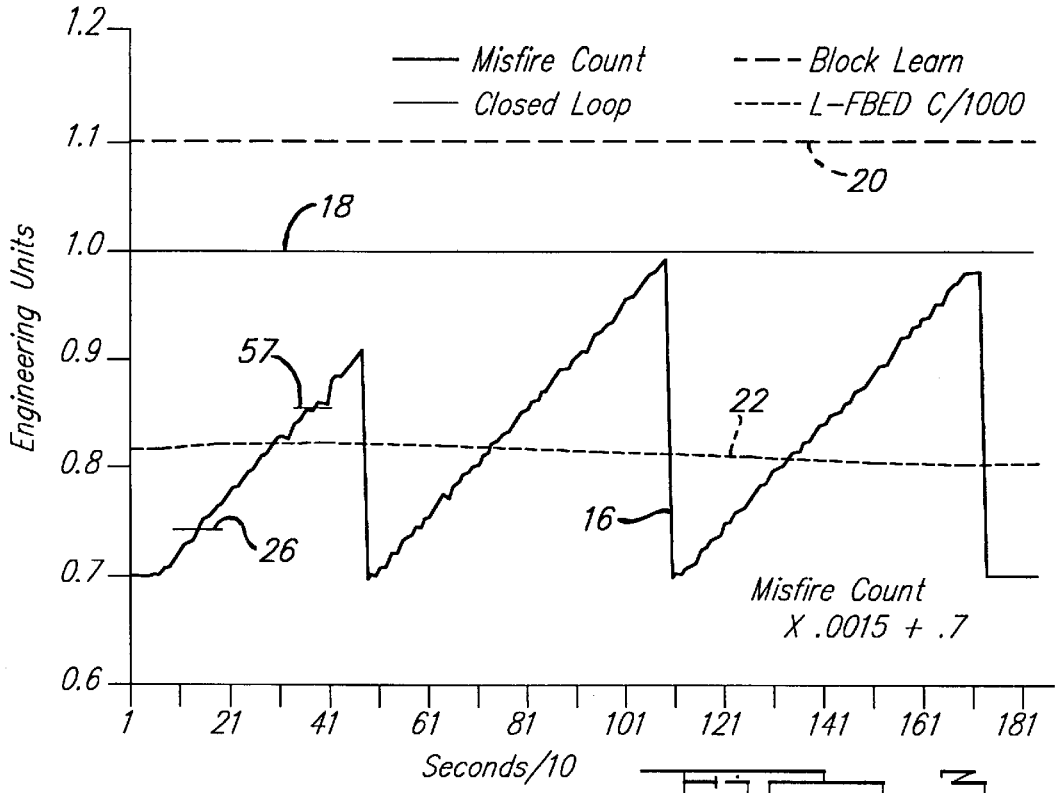
FIG. 3 is a graph depicting the same engine parameters of FIG. 2, but in a method and apparatus according to the present invention, the conditions are cylinder #1 injector disconnect, 2200 RPM, 75 gram/sec.

As shown in FIGS. 3 and 4B, when the method of the present invention is implemented, the immediate shutting off of fuel to the misfiring cylinders when the threshold 26, 28 and 57 are exceeded prevents non-combusted air and fuel from the misfiring cylinder(s) from flowing into the engine catalytic converter. This, in turn, not only prevents burning of the non-combusted air and fuel in the converter, but also, by disabling short and long term fuel control prevents the addition of fuel to the other cylinders of the engine which leads to further temperature increases in the converter as in prior misfire detector based control systems.

As shown in FIG. 3, the temperature of the front bed portion of the catalytic converter 22 remains substantially linear, even though there is a very slight temperature increase.

What is claimed:

1. A method for controlling engine parameters during an engine cylinder misfire in at least one cylinder of a multi-cylinder internal combustion engine, the method comprising the steps of:

detecting a cylinder misfire in at least one cylinder of a multi-cylinder engine;

counting the number of misfires in each cylinder on a cylinder by cylinder basis;

integrating the positive change in misfire count for each cylinder over time;

establishing a first threshold based on the integrated misfire count for each cylinder;

establishing a second threshold for a short term fuel control signal adjusting the flow of fuel to each cylinder of the engine;

comparing the integrated misfire count and the short term control signal with the first and second thresholds, respectively; and if the first and second thresholds are exceed at substantially the same time, shutting off fuel to at least one cylinder of the engine in which the misfire is occurring.

2. The method of claim 1 further comprising the steps of:

establishing a long term fuel control;

shutting off the short term and the long term fuel control; and resetting the short term and the long term fuel control to a reset value.

3. The method of claim 1 further comprising the steps of:

upon the occurrence of a detected misfire, determining in a first determination the engine cylinder numbers in which the fuel is shut-off;

in a second determination repeating the method of claim 1 to determine the cylinder number of cylinders in which fuel is shut off;

comparing the cylinder numbers from the first determination with the cylinder numbers from the second determination to determine a match;

if the cylinder numbers in the first and second determinations match, ending misfire detection control; and if the cylinder numbers in the first and second determinations do not match, turning on fuel to all of the cylinders and resetting the misfire counter to a reset value.

4. The method of claim 1 further comprising the step of:

establishing a noise threshold based on the number of misfire count for each cylinder; and comparing the misfire count with the first threshold and initiating integrating of the misfire count when the misfire count exceeds the first threshold.

5. An apparatus for controlling engine parameters during the occurrence of a misfire in at least one cylinder of a multi-cylinder internal combustion engine, the apparatus comprising:

means for receiving an output signal indicative of the occurrence of a misfire in at least one cylinder of a multi-cylinder internal combustion engine;

means for counting the number of misfires in each cylinder of the engine on a cylinder by cylinder basis;

means for integrating the positive change in a misfire counter output over time;

means for comparing the integrated misfire counter output with a first threshold;

means for comparing a short term air/fuel ratio correction signal with a second threshold; and means for determining when the integrated misfire counter output exceeds the first threshold at substantially the same time that the short term fuel correction signal exceeds the second threshold, the determining means providing an output signal for corrective engine control.

6. The apparatus of claim 5 further comprising:

means for verifying that fuel has been shut off in the at least one cylinder of the engine in which a misfire was detected.

7. The apparatus of claim 5 further comprising:

means for establishing a noise threshold; and means for comparing the misfire count with the first threshold to determine when the misfire count exceeds the noise threshold before integrating the misfire count.

* * * * *